United States Patent [19]

Sarro et al.

[11] 4,126,113

[45] Nov. 21, 1978

[54] ENGINE AIR STARTER

[76] Inventors: Manuel B. Sarro, 835 E. Lake, Houston, Tex. 77034; Richard D. Kriefeldt, 13814 Barryknoll, Houston, Tex. 77079

[21] Appl. No.: 842,603

[22] Filed: Oct. 17, 1977

[51] Int. Cl.[2] ..... F02N 7/08; F02N 15/06

[52] U.S. Cl. ..... 123/179 F; 74/7 R

[58] Field of Search ..... 74/6, 7 R, 7 A; 123/179 F

[56] References Cited

U.S. PATENT DOCUMENTS

| | | | |
|---|---|---|---|
| 3,051,136 | 8/1962 | Muehlhausen | 123/179 F X |
| 3,791,365 | 2/1974 | Pharr et al. | 123/179 F |
| 3,794,009 | 2/1974 | Wenrich et al. | 123/179 F |

*Primary Examiner*—Allan D. Herrmann
*Attorney, Agent, or Firm*—Jack W. Hayden

[57] ABSTRACT

An air starter includes a housing having a rotatable shaft extending longitudinally thereof. A gear is connected in a longitudinally extending helical groove on the shaft so that when the gear is moved along the shaft it engages an engine flywheel whereby the flywheel may be rotated by an air motor connected to the shaft. Piston means surround the shaft and sealably and slidably engage within a cylinder formed in the housing and the housing is provided with inlet and exhaust air passages for conducting air to the cylinder and discharging air therefrom. First spring means abut the piston means and the housing to urge the piston means to a first position in the housing. Annular means extend into the helical groove on the shaft and is arranged to rotate with the gear, therebeing second spring means between the gear and said annular means to retain said annular means disengaged from the gear when the piston means is in the first position. When air is supplied to the cylinder, the piston means is moved against the first spring means and engages the annular means with the gear to move the annular means and gear along the helical groove in the shaft to engage the gear with the engine flywheel. Means indicate when the gear engages the engine flywheel, and if the gear does not engage the flywheel the first time it abuts thereagainst, the annular means and gear are constructed and arranged so that upon subsequent operation of the piston means, the gear is rotated to align with and engage the engine flywheel.

5 Claims, 7 Drawing Figures

10
11
11a
11b
11c
11d
11f
12
13
14
15
18
19
19a
20
21
22
23
24
27
27a
27c
28
29
29a
30
31
35
36
37
39
39a
40
42
43
F
M
3 fig.6
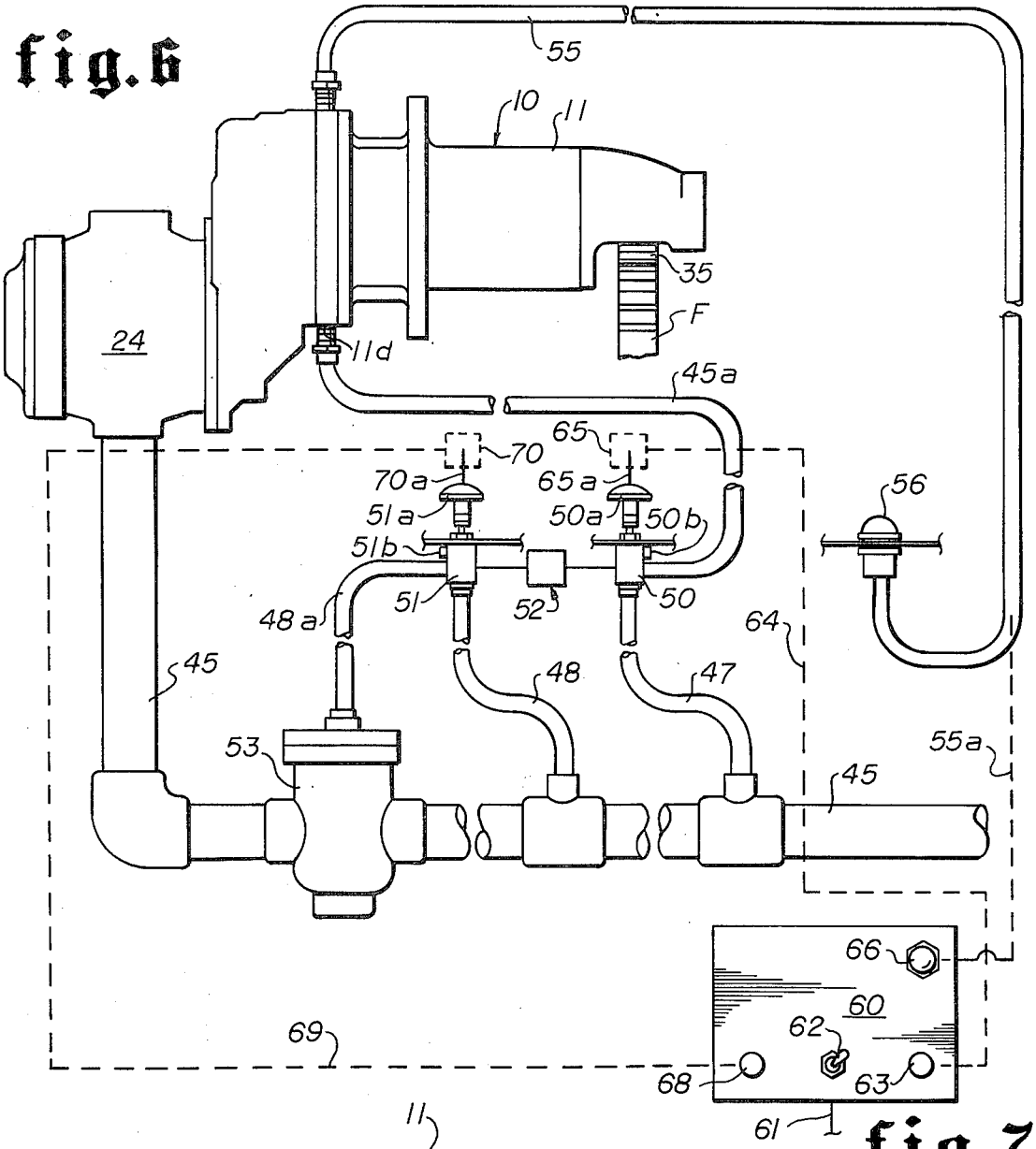
fig.7
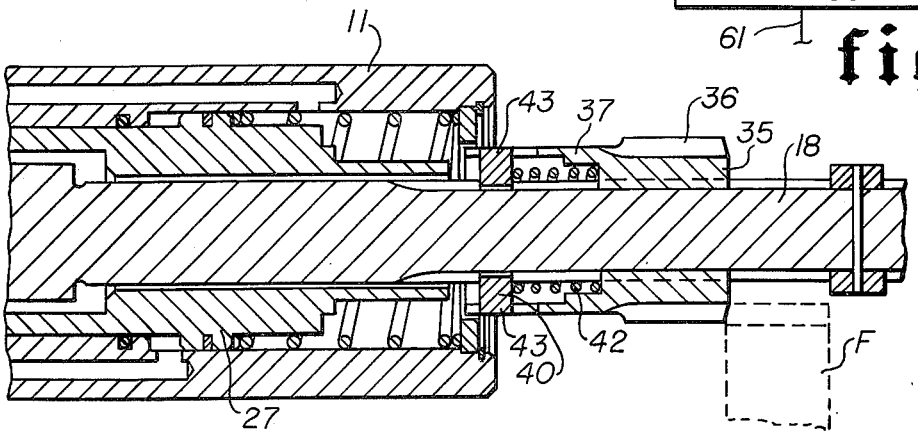
fig.5

ENGINE AIR STARTER

SUMMARY OF THE INVENTION

Various types of air starters have been proposed and are in use at the present time. One disadvantage with such air starters is that when the starter gear is moved longitudinally in a helical groove on a shaft to engage an engine flywheel so that the shaft can then be rotated to start an engine, the starter gear is quite often misaligned with the flywheel and does not intermesh with the flywheel. This has heretofore caused damage to the teeth on the gear or on the flywheel in some prior art devices.

Another disadvantage with air starters heretofore in use is that the shaft on which the starter gear is mounted and movable longitudinally for engagement with an engine flywheel may begin to rotate before the gear engages the flywheel which also inhibits proper engagement of the starter gear with the flywheel for rotation thereof or damage to the gear and the flywheel.

The present invention overcomes the above and other disadvantages with air starters presently in use in that it is construcuted and arranged so that if the starter gear does not mesh with the flywheel, the air supply can be released and then reactivated with the air starter being constructed and arranged so that upon such reactivation, the gear is rotated slightly to assist in aligning it for meshing with the gear teeth on the flywheel.

Yet a further object of the present invention is to provide indicating means for indicating when the starter gear of an air starter is engaged with a flywheel so that air may then be supplied to an air motor for rotation of the shaft on which the starter gear is mounted to rotate the gear and engage the flywheel.

A further object of the present invention is to provide an air starter which is constructed and arranged to assist in aligning a longitudinally movable starter gear on a shaft with a flywheel for engagement thereof with means for indicating the engagement of the gear and the flywheel and means for conducting air to an air motor for rotation of the shaft and the engaged starter gear and flywheel.

Yet a further object of the present invention is to provide an arrangement for an air starter wherein the air starter is provided with a starter gear longitudinally movable on a rotatable shaft for engagement with a flywheel to rotate the flywheel wherein the starter gear may be aligned with the gear teeth on the flywheel for engagement therewith in a manner to inhibit damage to the starter gear teeth as well as the gear teeth on the flywheel. Such arrangement is also constructed and arranged so that the gear on the rotatable shaft may engage the flywheel before air is supplied to an air motor for rotating the rotatable shaft on which the starter gear is mounted.

Other objects and advantages of the present invention will become more readily apparent from a consideration of the following description and drawings.

BRIEF DESCRIPTION OF THE DRAWINGS

FIG. 5 is a partial longitudinal sectional view illustrating the relationship of the components of the present invention when the gear has been moved to abut the flywheel but is misaligned therewith with the piston means moved to its first position in the housing for reactivation to rotate and align the gear on the rotatable shaft with the flywheel;

FIG. 6 is a schematic view illustrating the arrangement for operating the starter of the present invention; and FIG. 7 illustrates a control panel for remote operation to sequentially and selectively control the flow of air to the starter and to the air motor which rotates the rotatable shaft of the starter to impart rotation to the gear on the shaft and the flywheel engaged with the gear.

DESCRIPTION OF THE PREFERRED EMBODIMENT

Figures 1, 2:
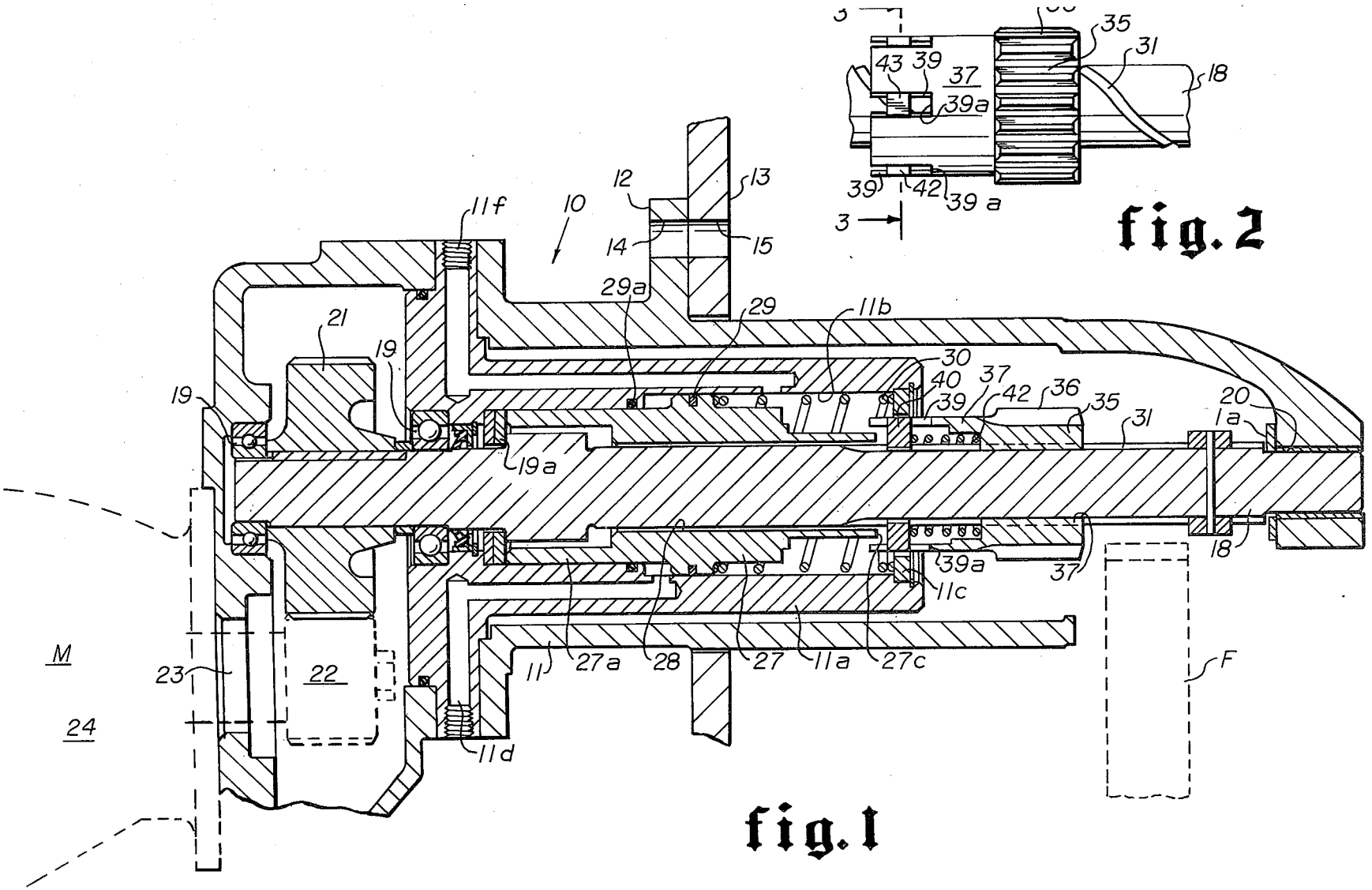
FIG. 1 is a longitudinal sectional view illustrating the preferred embodiment of the present invention.
FIG. 2 is an enlarged partial view of the starter gear arrangement and the shaft on which it is mounted.

In FIG. 1 the air starter is referred to generally by the numeral 10 and is shown as having a longitudinally extending housing 11 including a mounting bracket 12 which may be mounted to the bracket 13 by any suitable means such as bolts or the like extending through the mating openings 14 and 15 in the mounting brackets 12 and 13.

A rotatable shaft 18 extends longitudinally of the housing and is rotatably supported therein by suitable bearing means 19 and suitable sleeve bearing means 20 as shown in FIG. 1. Suitable thrust bearing means **19*a* are also provided between the shaft 18 and housing 11. A bull gear 21 is mounted at one end of the shaft 18 and engages with a pinion 22 carried by the shaft 23 of the air motor 24 for rotation of the shaft 18** as will be explained hereinafter.

The housing 11 includes a longitudinally extending portion **11*a* which forms a longitudinally extending cylinder 11*b* as shown in FIG. 1 of the drawings. Piston means 27 is provided with a central opening 28 so that the piston means 27 surrounds the longitudinally extending shaft 18 as shown within the cylinder 11*b*. The piston means 27 includes suitable seal means 29 for slidably and sealably engaging the cylinder 11*b*. Suitable seal means 29*a* are provided on the housing portion 11*a* to sealably engage with the extension 27*a* of the piston means 27 as the piston means 27 is moved longitudinally of the cylinder 11*b*. A spring 30 abuts an end 11*c* of the housing portion 11*a* and the piston means 27 to normally retain the piston means 27** in the first position as illustrated in FIG. 1 of the drawings.

The housing 11 is provided with a suitable air inlet **11*d* whereby air may be supplied to the cylinder 11*b* to move the piston 27 longitudinally against the force of the spring 30. When the piston has moved to the right as illustrated in FIG. 4 so that seal 29 enable the air in cylinder 11*b* to communicate with exhaust passage 11*f*, air is exhausted from the cylinder 11*b***.

The shaft 18 is provided with a helical groove 31 from adjacent the end **11*c* of housing portion 11*a* to the end thereof as illustrated in the drawings. A gear 35 having teeth 36 thereon has a depending portion 37 fitting in the groove 31 as shown in the drawings. The gear 35 also includes a cylindrical portion 37 extending rearwardly thereof with circumferentially spaced, longitudinally extending slots 39 formed in the cylindrical extension 37** as shown in FIGS. 2 and 3.

Figure 3:
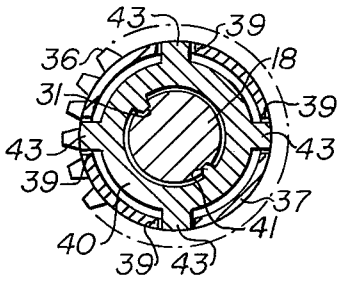
FIG. 3 is a sectional view on the line 3—3 of FIG. 2 to illustrate further structural details of the starter gear and cooperating means associated therewith.

An annular member 40 is provided with inwardly extending projections 41 to fit in the helical groove 31 as shown in FIG. 3 and includes outwardly extending projections 43 for interconnecting in the slots 39 of the cylindrical portion 37. Second spring means 42 abut the starter gear 35 and the annular member 40 to normally maintain the annular member 40 in spaced relation relative to the end 39*a* of the slots as shown in FIG. 1 of the drawings.

Figure 4:
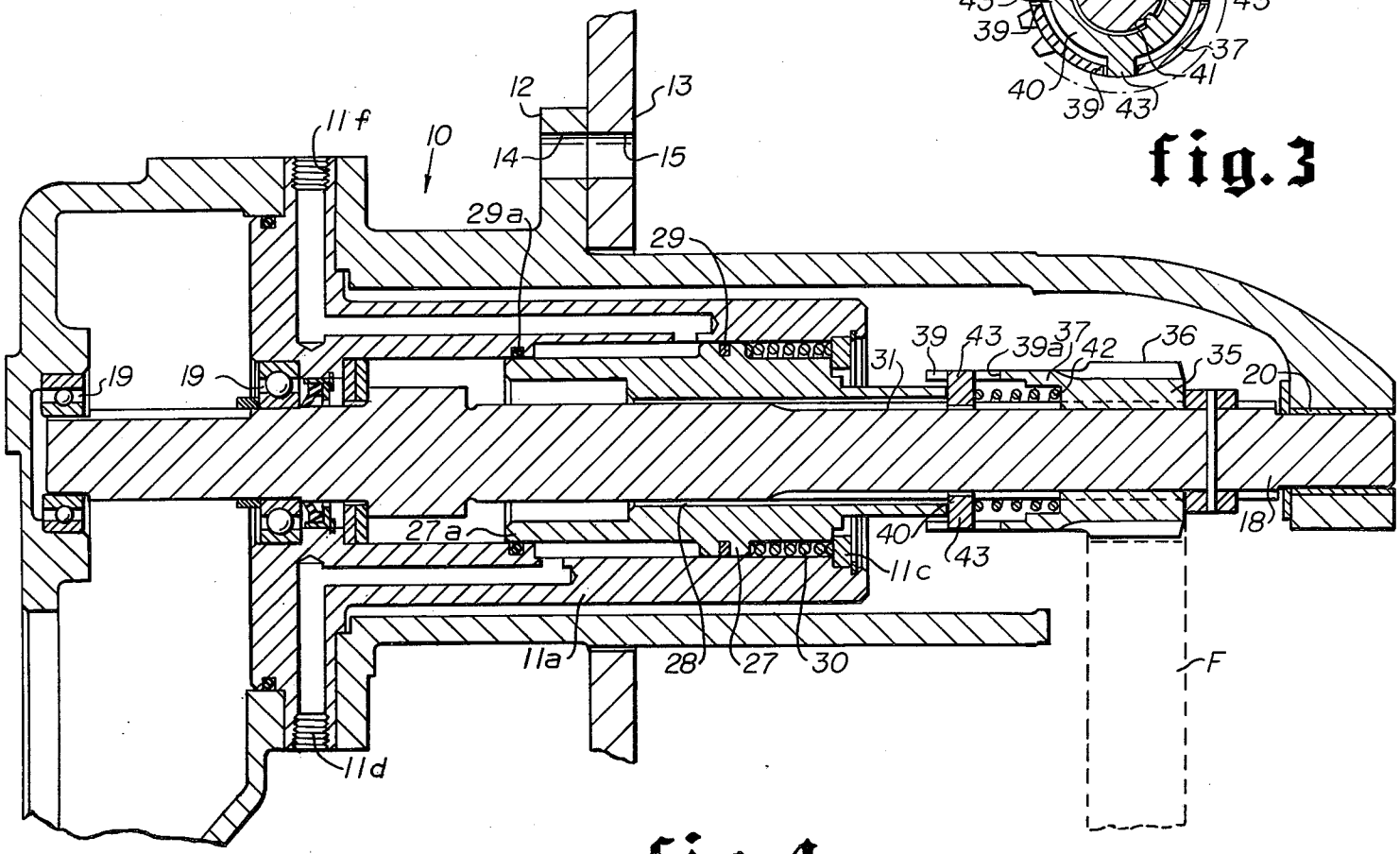
FIG. 4 is a longitudinal sectional view similar to FIG. 1 but illustrating the starter gear engaged with the flywheel.

A flywheel designated F is shown in dotted line in FIGS. 1, 4, and 5 with which the gear 35 is to be engaged whereby the air motor 24 may there rotate shaft 18 to rotate the flywheel F to start an engine such as a diesel engine or the like.

In FIG. 6 the arrangement for supplying air to actuate the air starter 10 of the present invention is illustrated. A conduit 45 is connected to a source of air under pressure in which are connected branch conduits 47 and 48. The branch conduits are each provided with normally closed, spring loaded valve means 50 and 51. If desired, an interconnecting valve arrangement referred to generally at 52 between the valve means 50 and 51 may be provided for a purpose as will be described.

A main valve 53 in the conduit 45 prevents communication of air to the air motor 24 until the valve means 51 has been actuated as will be described.

In operation of the present invention the knob 50*a* on the top of the valve stem of the valve means 50 is manually depressed to open spring loaded valve means 50 when it is desired to flow air from the air supply conduit 45 to the inlet 11*d* in the housing to actuate the air starter 10. If the arrangement includes the valve means 52 of a suitable air valve of well known construction simultaneous depression or actuation of the valve means 50 and 51 is inhibited. At any event, the valve means 50 must be first actuated so that the air starter 10 is operated to engage the gear 35 with the flywheel F before the valve means 51 can be actuated to supply air to the air motor 24 to effect rotation of the shaft 18 in the starter 10.

When air is supplied to the inlet 11*d* of the housing, it passes through open valve 50 and conduit 45*a* to the cylinder 11*b* and forces the piston means 27 against the force of the spring 30 so that the piston end 27*c* engages the annular member 40 and moves it along the helical spline 31 in shaft 18. Movement of the member 40 collapses the spring 42 and enables the projections 43 on annular member 40 to engage the ends 39*a* of the slots 39 to also urge the gear 35 longitudinally of the shaft 18 in the helical groove 31. As the gear 35 is moved on shaft 18 towards the flywheel F, it rotates by reason of its interfitting relationship in the helical groove 31 on shaft 18 and if the gear teeth 36 are aligned with the gear teeth on the flywheel F, the gear 35 will engage with the flywheel F as shown in FIG. 4 of the drawings.

When this occurs, the piston means 27 is positioned so that seal means 29 has cleared the exhaust passage 11*f* enabling air to exhaust from the housing 11 and through the conduit 55 to actuate the pneumatic visual indicator 56 to indicate that the gear 35 is engaged with the flywheel F.

If however the gear teeth 36 on the gear 35 are not aligned with the gear teeth on the flywheel F when the gear 35 moves along shaft 18 and engages flywheel F as illustrated in FIG. 5, then the gear cannot be engaged with the flywheel, but will abut it as shown in FIG. 5.

By manually releasing knob 50*a*, the spring loaded valve 50 closes and air trapped in conduit 45*a* and cylinder 11*b* is discharged through the exhaust port 50*b* of the valve means 50 enabling the piston means 27 to return to its first position as shown in FIG. 1 of the drawings. However, the gear 35 will remain in close proximity to flywheel F but the second spring 42 will cause the annular member 40 to back off from engagement with the slot ends 39*a* in the cylindrical portion 37 of the gear 35 as illustrated in FIG. 5. Knob 50*a* can then be again depressed to move piston means 27 forwardly so as to again engage the annular member 40 and rotate it. As it rotates, it will also rotate the gear 35 slightly and as the gear 35 is rotated and urged towards the flywheel, it will then engage with the gear teeth of the flywheel.

When the gear 35 is engaged with the flywheel F, knob 51*a* on spring loaded valve means 51 is depressed so that the valve stem and valve therein is actuated to permit air to flow from the conduit 45 through the conduit 48 and through the 48*a* to the valve 53 and open it. When the valve 53 is open, air is then supplied through the conduit 45 to the air motor 24 to rotate the pinion 22 and connected bull gear 21 on the shaft 18. Rotation of the shaft 18 causes rotation of the gear 35 and flywheel F to start the motor.

After the motor 24 has performed its function, knob 51*a* is released and air may exhaust through exhaust port 51*b*. This enables valve 53 to return to closed position in conduit 45.

It can be appreciated that at this time the piston means 27 has been returned to its initial position as illustrated in FIG. 1 of the drawings by the spring 30 since air has been released and the gear 35 is still engaged with the flywheel F and will remain engaged until the flywheel F reaches sufficient speed to throw the gear 35 back along the shaft 18 in the helical groove 31 to its initial position as is shown in FIG. 1 of the drawings.

Where it is desired to operate the starter from a remote position a control panel as illustrated at 60 may be provided which is connected with a suitable source of electrical power as illustrated at 61. When the switch at 62 is turned on, to supply power to the control panel 60, the button 63 may be depressed which supplies electrical energy through the conduit 64 to the solenoid illustrated in dotted line at 65. The solenoid 65 is then actuated so that its plunger 65*a* depresses the knob 50*a* in a manner similar to that described with regard to the manual depression herein.

After the gear 35 of the starter of the present invention has been engaged with the flywheel F, the indicator light 66 will come on since the air in conduit 55*a* will actuate a pneumatic switch on the control panel to supply electric current for light 66. Such pneumatic switch is of well known construction.

After the gear 35 is engaged with the flywheel 35 the button 68 on control panel 60 may be depressed so as to supply power through the electrical conduit 69 to the solenoid 70 whereupon its plunger 70*a* moves down to actuate the plunger 50*a* connected with the valve stem of valve means 51. Thereupon air may be supplied to the air motor 24 as previously described herein.

From the foregoing, it can be appreciated that the present invention provides an air starter which is constructed and arranged so as to enable the starter gear to be properly aligned for engagement with the gears of a flywheel so as to inhibit damage to the gear teeth of the starter gear or the flywheel. Also, the arrangement is such that the starter is positively engaged with the flywheel before air is supplied to an air motor for operating the starter to rotate the flywheel and start the engine with which the flywheel is associated.

The foregoing disclosure and description of the invention are illustrative and explanatory thereof, and various changes in the size, shape, and materials as well as in the details of the illustrated construction may be made without departing from the spirit of the invention.

What is claimed is:

1. In an air starter wherein a rotatable shaft extends longitudinally of a housing with a gear connected in a longitudinally extending helical groove on the shaft so that when the gear is moved along the shaft it engages an engine flywheel for rotation by the shaft, the invention comprising:

a. piston means surrounding the shaft and sealably and slidably engaging within a cylinder formed in the housing;

b. the housing having inlet and exhaust air passages for conducting air to the cylinder and discharging air therefrom;

c. first spring means abutting said piston means and the housing to urge said piston means to a first position in the housing;

d. annular means in the helical groove rotatably connected with the gear and movable longitudinally on the shaft by said piston means to abut the gear;

e. second spring means between said annular means and the gear to retain the gear and said annular means in nonabutting relationship when said piston means is in said first position; and f. said piston means movable in response to air pressure in the housing inlet to engage and rotate said annular means to assist in aligning the gear for engagement with the flywheel.

2. The invention of claim 1 including means to indicate when the gear engages the flywheel.

3. In an air starter wherein a rotatable shaft extends longitudinally of a housing with a gear connected in a longitudinally extending helical groove on the shaft so that when the gear is moved along the shaft it engages an engine flywheel for rotation by the shaft, the invention comprising:

a. piston means surrounding the shaft and sealably and slidably engaging within a cylinder formed in the housing;

b. the housing having inlet and exhaust air passages for conducting air to the cylinder and discharging air therefrom;

c. first spring means abutting said piston means and the housing to urge said piston means to a first position in the housing;

d. an annular member extending into the helical groove on the shaft with projections engaging in longitudinal slots on the gear;

e. second spring means between the gear and said annular member to retain said projections disengaged from the slot ends when said piston means is in said first position;

f. said piston means being movable longitudinally of the shaft in response to air pressure in the housing inlet to engage said annular member with the gear and move it into engagement with the flywheel for rotation by the shaft; and g. the exhaust air passage being positioned to discharge air from the cylinder when the gear engages the flywheel whereby said piston means is returned to its first position by said first spring means.

4. In an air starter wherein a rotatable shaft extends longitudinally of a housing with a gear connected in a longitudinally extending helical groove on the shaft so that when the gear is moved along the shaft it engages an engine flywheel for rotation by the shaft, the invention comprising:

a. piston means surrounding the shaft and sealably and slidably engaging within a cylinder formed in the housing;

b. the housing having inlet and exhaust air passages for conducting air to the cylinder and discharging air therefrom;

c. first spring means abutting said piston means and the housing to urge said piston means to a first position in the housing;

d. annular means in the helical groove rotatably connected with the gear and movable longitudinally on the shaft by said piston means to abut the gear;

e. second spring means between said annular means and the gear to retain the gear and said annular means in nonabutting relationship when said piston means is in said first position;

f. said piston means movable in reponse to air pressure in the housing inlet to engage and rotate said annular means to assist in aligning the gear for engagement with the flywheel;

g. an air motor for rotating the shaft;

h. conduit means for conducting air to the air motor and the starter; and i. control valve means in said conduit means for selectively controlling the flow of air to the motor and starter.

5. The invention of claim 4 wherein said control valve means is solenoid actuated.

* * * * *